US006499493B1

(12) United States Patent
Keenan

(10) Patent No.: US 6,499,493 B1
(45) Date of Patent: Dec. 31, 2002

(54) WASHED SAND DRYING AND HANDLING PLANT

(76) Inventor: Kevin Gerard Keenan, Silver Hills Lower, Ballymore Eustace, Naas, County Kildare (IE)

( * ) Notice: Subject to any disclaimer, the term of this patent is extended or adjusted under 35 U.S.C. 154(b) by 0 days.

(21) Appl. No.: 09/380,390

(22) PCT Filed: Feb. 27, 1998

(86) PCT No.: PCT/IE98/00016

§ 371 (c)(1),
(2), (4) Date: Aug. 27, 1999

(87) PCT Pub. No.: WO98/37971

PCT Pub. Date: Sep. 3, 1998

(30) Foreign Application Priority Data

Feb. 27, 1997 (IE) ..... S970121

(51) Int. Cl.[7] ..... B08B 3/04

(52) U.S. Cl. ..... 134/61; 134/110; 134/201; 34/236

(58) Field of Search ..... 134/110, 111, 134/109, 201, 61, 133; 34/165, 179, 236

(56) References Cited

U.S. PATENT DOCUMENTS 13,557 A * 9/1855 Wilbur
3,526,098 A * 9/1970 Huhn et al.
3,717,307 A * 2/1973 Beck
3,941,679 A * 3/1976 Smith et al.
4,008,856 A * 2/1977 Sears
4,106,518 A * 8/1978 Buzga et al.
4,132,010 A * 1/1979 Deland
4,187,167 A * 2/1980 Havlik et al.
4,257,168 A * 3/1981 Carroll et al.
4,265,939 A * 5/1981 Tebbens et al.
4,303,453 A * 12/1981 Jung et al.
4,325,819 A * 4/1982 Altizer
4,445,523 A * 5/1984 Bruning et al.
4,678,558 A * 7/1987 Belluteau et al.
5,056,541 A * 10/1991 Schade et al.
5,129,164 A * 7/1992 Painter et al.
5,211,215 A * 5/1993 Sommer
5,266,494 A * 11/1993 Lohoda et al.
5,342,449 A * 8/1994 Holbein et al.
5,426,866 A * 6/1995 Rumocki
5,453,133 A * 9/1995 Sparks et al.
5,454,878 A * 10/1995 Bala et al.
5,552,051 A * 9/1996 Wang et al.
5,596,816 A * 1/1997 Mills et al.
5,637,152 A * 6/1997 Robinson et al.
5,762,780 A * 6/1998 Rendall et al.
5,846,314 A * 12/1998 Golley
5,967,965 A * 10/1999 Vyshkina et al.

* cited by examiner

*Primary Examiner*—Frankie L. Stinson
(74) *Attorney, Agent, or Firm*—Tod R. Nissle, P.C.

(57) ABSTRACT

A washed sand drying and handling plant (100) includes a belt feed hopper (1), a conveyor belt (2), a sand rinsing unit (3), a dewatering apparatus (4), a radial conveyor (5) and a sand drying and handling apparatus (6). The sand drying and handling apparatus (6) includes four vesssels or tanks (7). Each tank (7) is generally cylindrically shaped and has a cone-shaped base. Sand is held in the tanks (7) for a predetermined amount of time sufficient to allow the sand to dry to the desired level by gravity.

13 Claims, 12 Drawing Sheets

WASHED SAND DRYING AND HANDLING PLANT

The present invention concerns washed sand drying and handling plant. Traditionally, after sand has been washed, it is allowed to slide down a chute onto a conveyor belt which then transports the sand to a stockpile. This just-washed sand usually contains about 22–26% w/w moisture content. Thus, the sand is still quite wet and it must be dried to about 8–10% w/w moisture content before it can be transferred to another stockpile using loading shovels or dumpers. This method of drying and handling sand is time consuming, labour-intensive and costly. It is necessary to wait about 14 hours before the washed sand can actually be used. Therefore, if the stockpile of dried washed sand available for use is small, it would be necessary to wait 14 hours before any further stocks of dried washed sand would be available for use.

The specification of DE-A-33 08 540 discloses an apparatus for the dewatering and drying of, for example, the sand from the sludge liquor of a gravel washing plant. The apparatus comprises two sludge separating stages which each comprise a horizontally extending tank container which has a collecting trough at its bottom end, parallel to its longitudinal axis, in which trough a worm conveyor rotates. The trough opens into an elevator ending in the region of a sludge drying container, which elevator likewise has a worm conveyor, each horizontal tank container bearing, in the upper region of its shell, an inlet basin for the sludge flow and an overflow basin for the sludge flow having reduced proportion of sludge.

The present invention seeks to alleviate the disadvantages associated with the above.

The present invention accordingly provides a washed sand drying and handling plant comprising: apparatus for washing with water sand with water; apparatus for dewatering the washed sand; apparatus for transporting the washed sand from the dewatering apparatus to a vessel adapted for storing the dewatered sand and enabling the sand to dry by gravity, the sand being held in the vessel for a predetermined amount of time sufficient to allow the sand to dry to the desired level wherein each vessel includes an inner membrane through which the liquid from the washed sand in the vessels drains. Preferably, the plant includes means for collecting and recycling the drained liquid to the dewatering apparatus.

Conveniently, the plant includes a plurality of said vessels, whereby when a first vessel is full, sand from the dewatering apparatus is delivered to a second vessel and so on.

The present invention also includes a conveyor by means of which the sand is deliverable from the dewatering apparatus to the vessel, the conveyor being moveable through an arc, so that the conveyor can be moved through a predetermined angle when the first vessel is full, resulting in the conveyor being positioned over a mouth of the second vessel and the dewatered sand being delivered to the second vessel.

Conveniently, each vessel comprises a tank having a cone shaped lower section with the inner membrane forming an inner wall of the cone and having a multiplicity of apertures to allow liquid to drain into a space between the inner wall and an outer wall of the cone.

Preferably, the membrane is provided on a removable filter element mountable within the outer wall of the cone.

Advantageously, a water supply is provided in the space between the inner and outer walls of the cone. More advantageously, the or each vessel is provided with a detector to ascertain when it is full.

Ideally, a moisture probe is located at the base of the vessel for determining when the sand is at the required moisture level.

Conveniently, a door is provided at the base of the or each vessel and a conveyor is located between the door or doors of the vessel or vessels, with the or each door being openable.

Advantageously, an adjustable chute is provided at the head of the transporting apparatus to direct sand into a vessel.

The present invention also provides a vessel for holding wet sand, the vessel including an inner membrane through which the liquid from the washed sand in the vessel drains, the vessel further including a conical base, a complementary shaped filter within the base spaced from the walls of the base to provide a drainage space between the filter and the base, whereby sand deposited in the vessel dries by gravity and without the use of a heat source.

The invention will now be described more particularly with reference to the accompanying drawings in which are shown, two embodiments of plant according to the invention.

Figure 1:
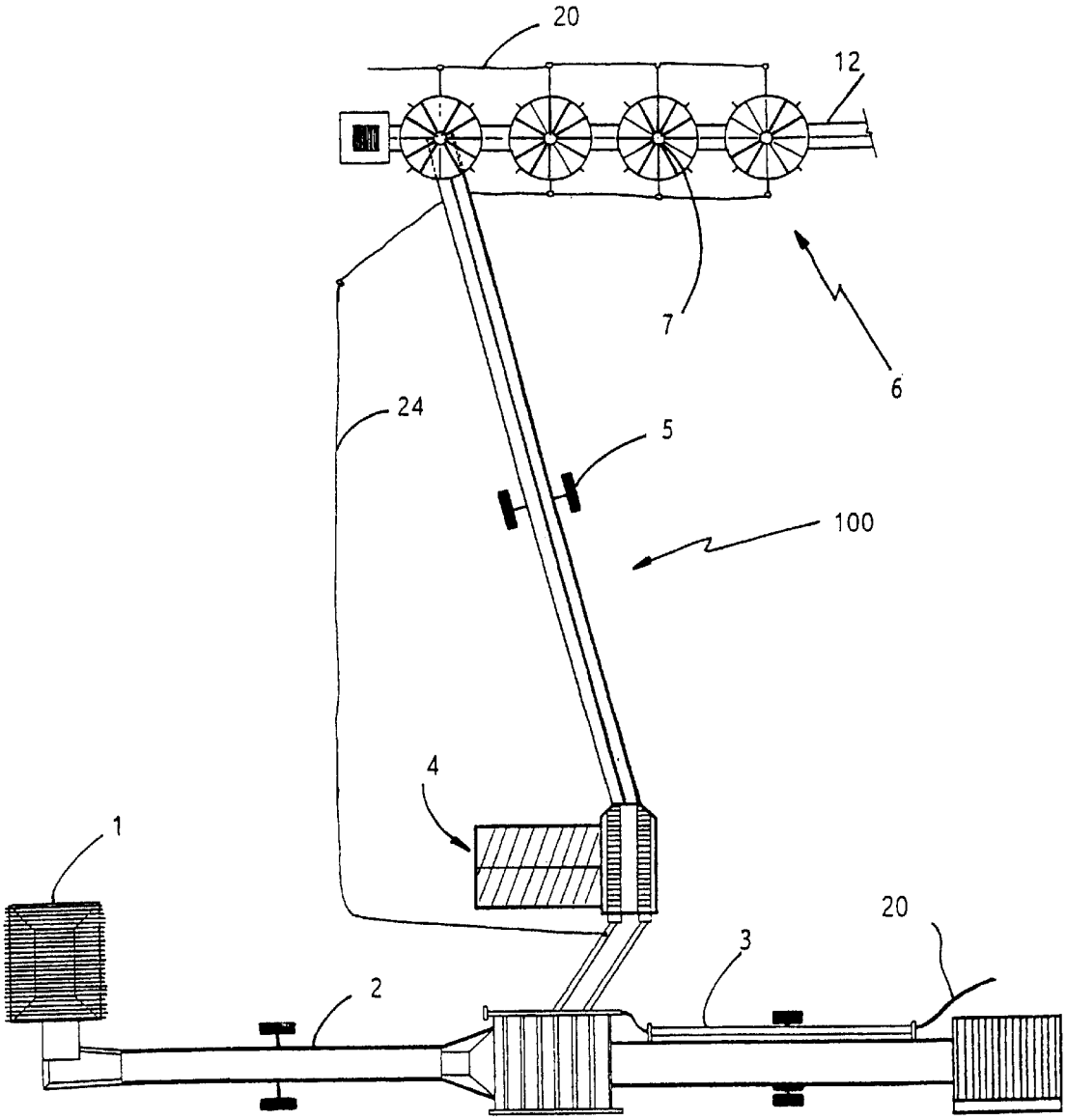
FIG. 1 is a plan view of the first embodiment of plant according to the invention.
Figure 2:
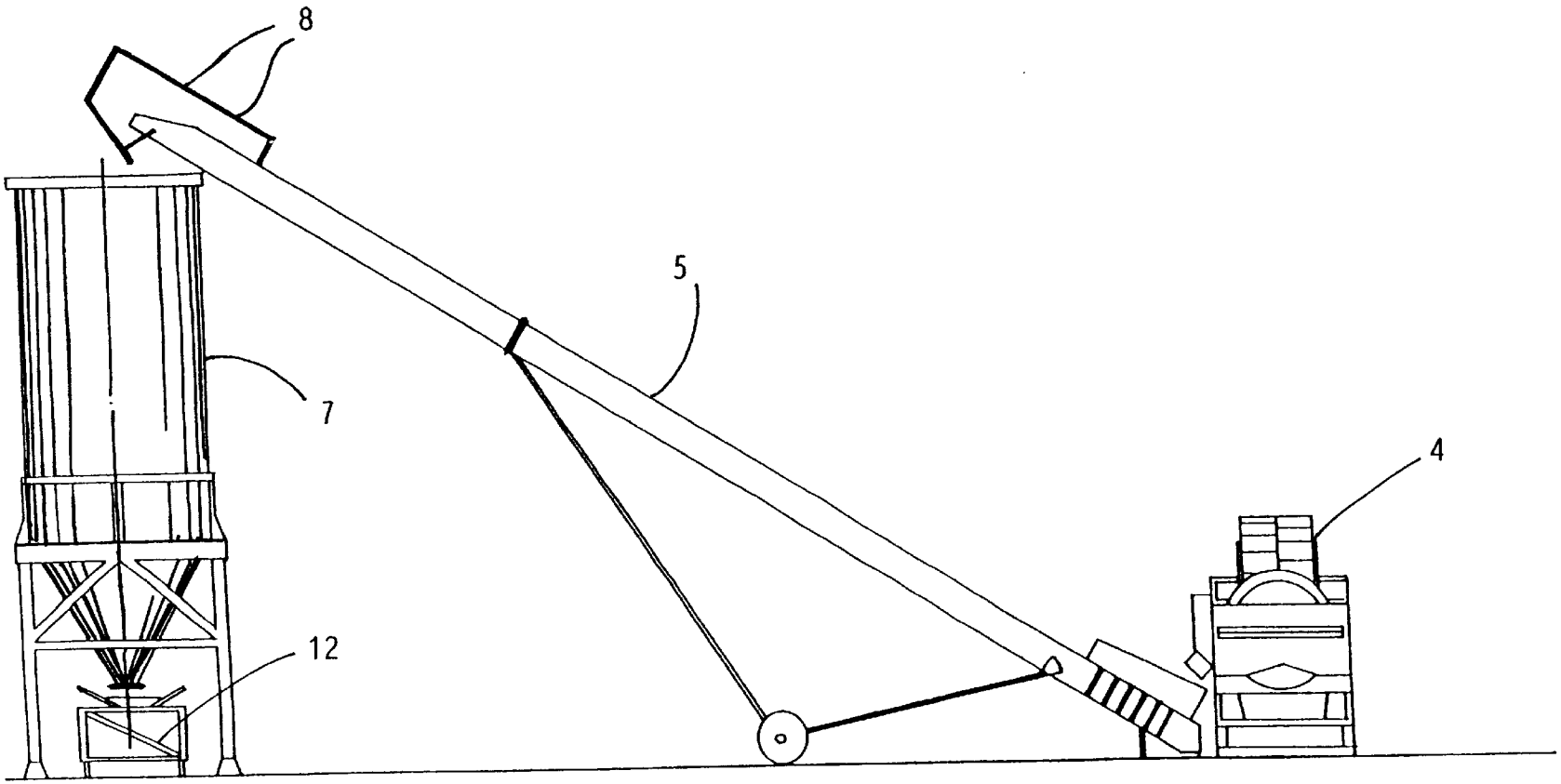
FIG. 2 is a side elevation of the plant shown in FIG. 1.
Figure 3:
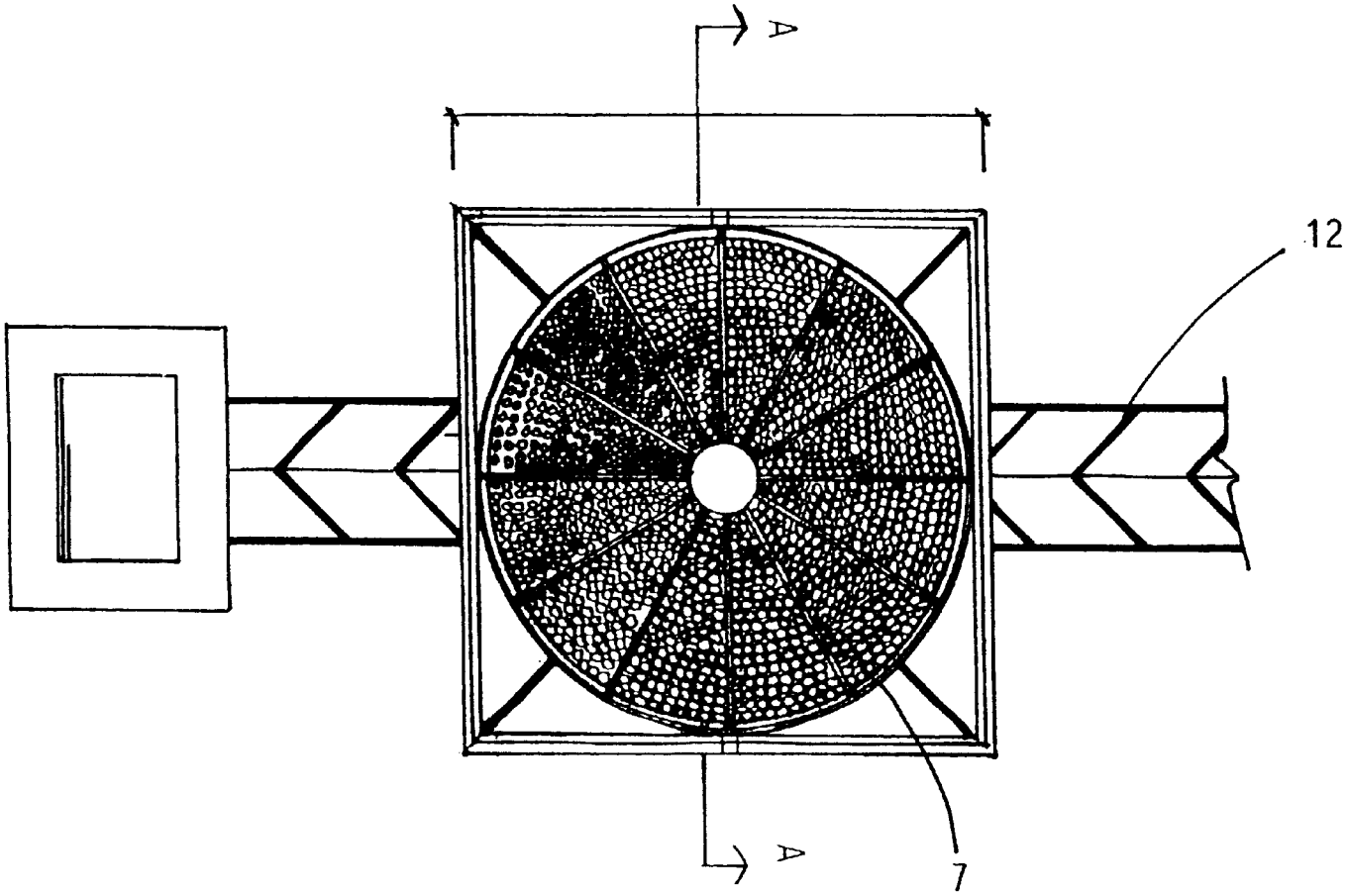
FIG. 3 is a plan view of a circular cross-section tank included in the plant.

In FIGS. 1 to 5 of the drawings, the plant is indicated generally by the reference numeral 100 and includes a belt feed hopper 1, a conveyor belt 2, a sand rinsing unit 3, a dewatering apparatus 4, a radial conveyor 5 and a sand drying and handling apparatus 6. The sand drying and handling apparatus 6 includes four tanks 7. The conveyor 5 includes an adjustable chute 8 to direct sand into a tank 7.

Figure 4:
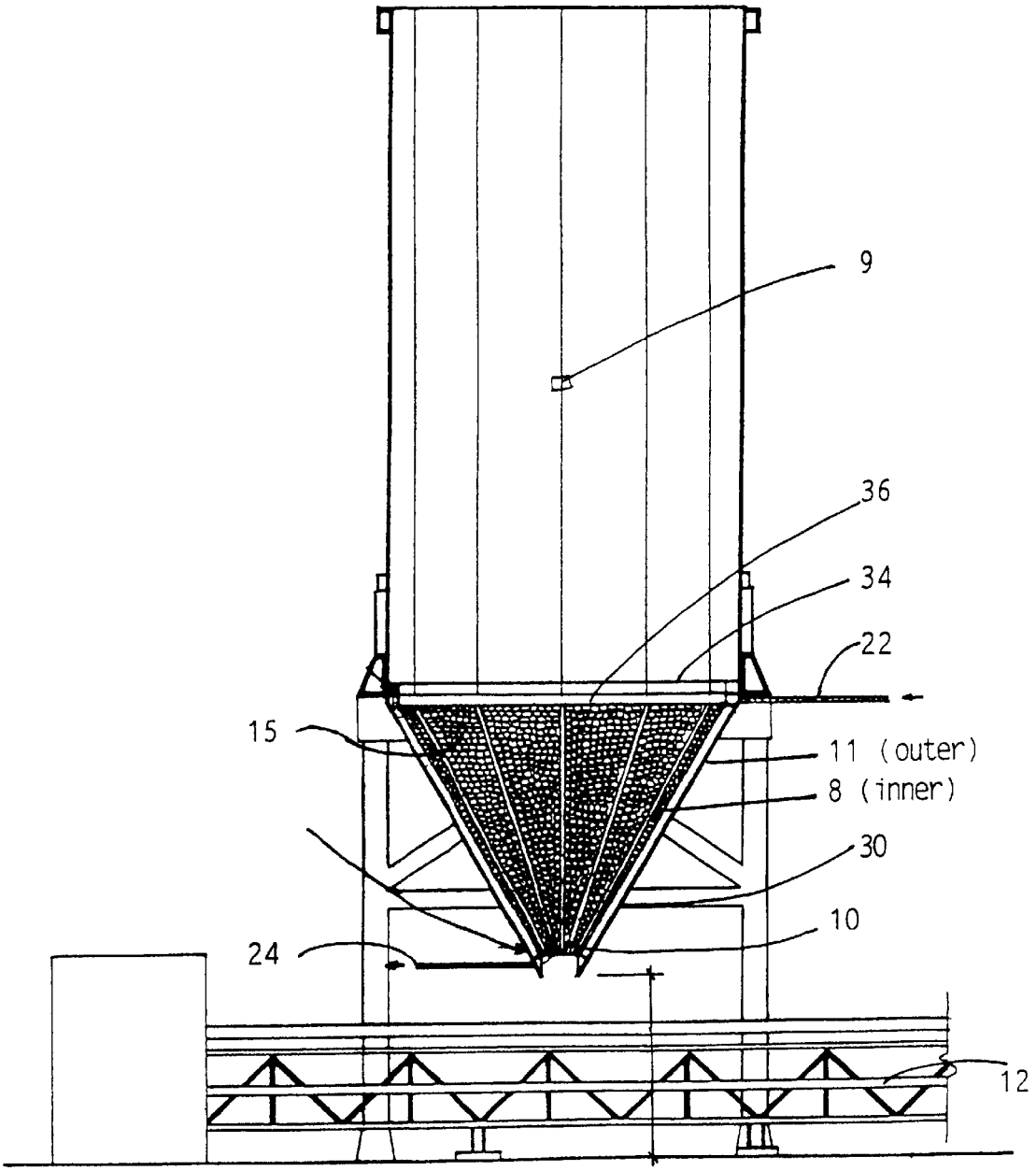
FIG. 4 is a sectional view along the line A—A of FIG. 3.
Figure 5:
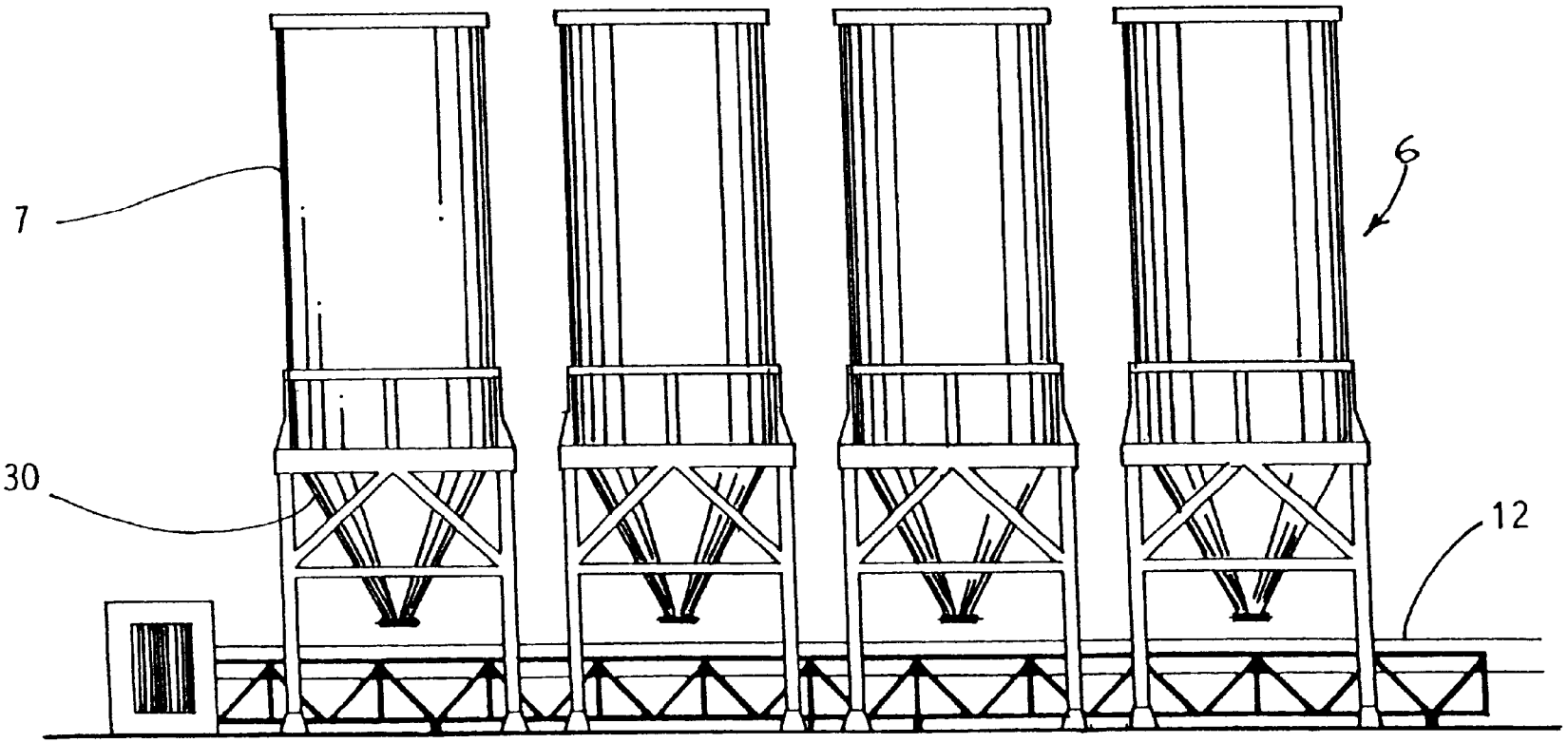
FIG. 5 is a front view of a plurality of tanks included in the first embodiment of the plant of the invention.
Figure 6:
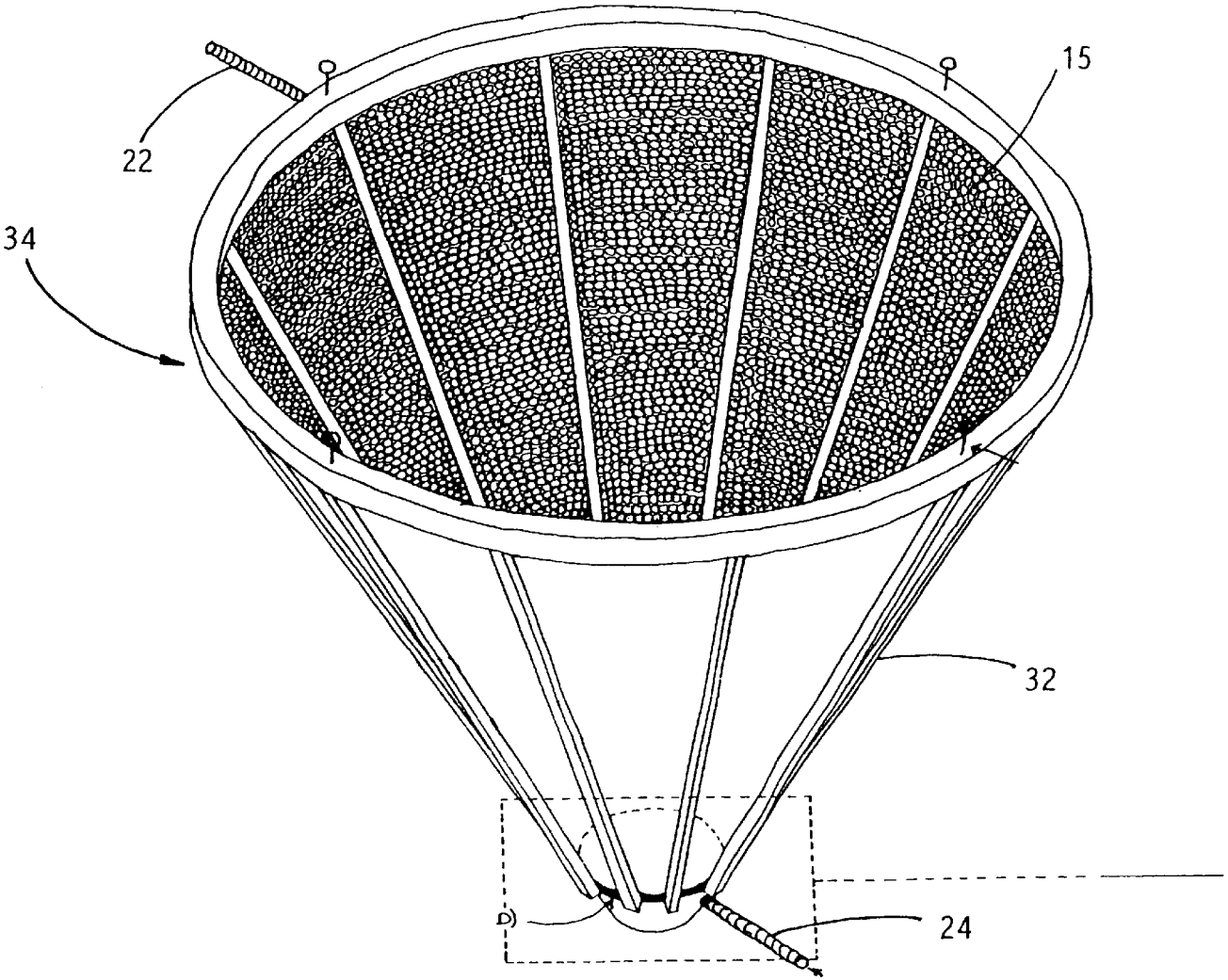
FIG. 6 is a perspective view of a cone shaped filter portion of one of the tanks, with the outer wall of the cone not shown for clarity.

Each tank 7 is generally cylindrically shaped, though the side of the tank tapers at its base to form a cone shaped base 30 as shown in FIG. 4. Within the base 30 is a removable cone shaped filter 32 as shown in FIG. 6. Each filter 32 has a ring 34 which sits on a support 36 (see FIG. 4).

Each tank 7 includes a motion detector 9 and a moisture probe 10. Each tank 7 has a capacity which is appropriate to the throughput of a particular sand drying and handling plant 100. For example, if a plant produces 1000 tonnes of washed sand in an eight hour period, four tanks having a capacity of 100 tonnes each will be needed, as shown in this particular embodiment of the invention. Using the plant 100 of the invention, it takes approximately one hour to dry 100 tonnes of wet sand from 22–26% w/w moisture content to 8–10% w/w moisture content. Since there are four tanks 7, there will always be one empty tank available so that washed and dried sand can be produced throughout the day without running short of tank capacity.

Figure 7:
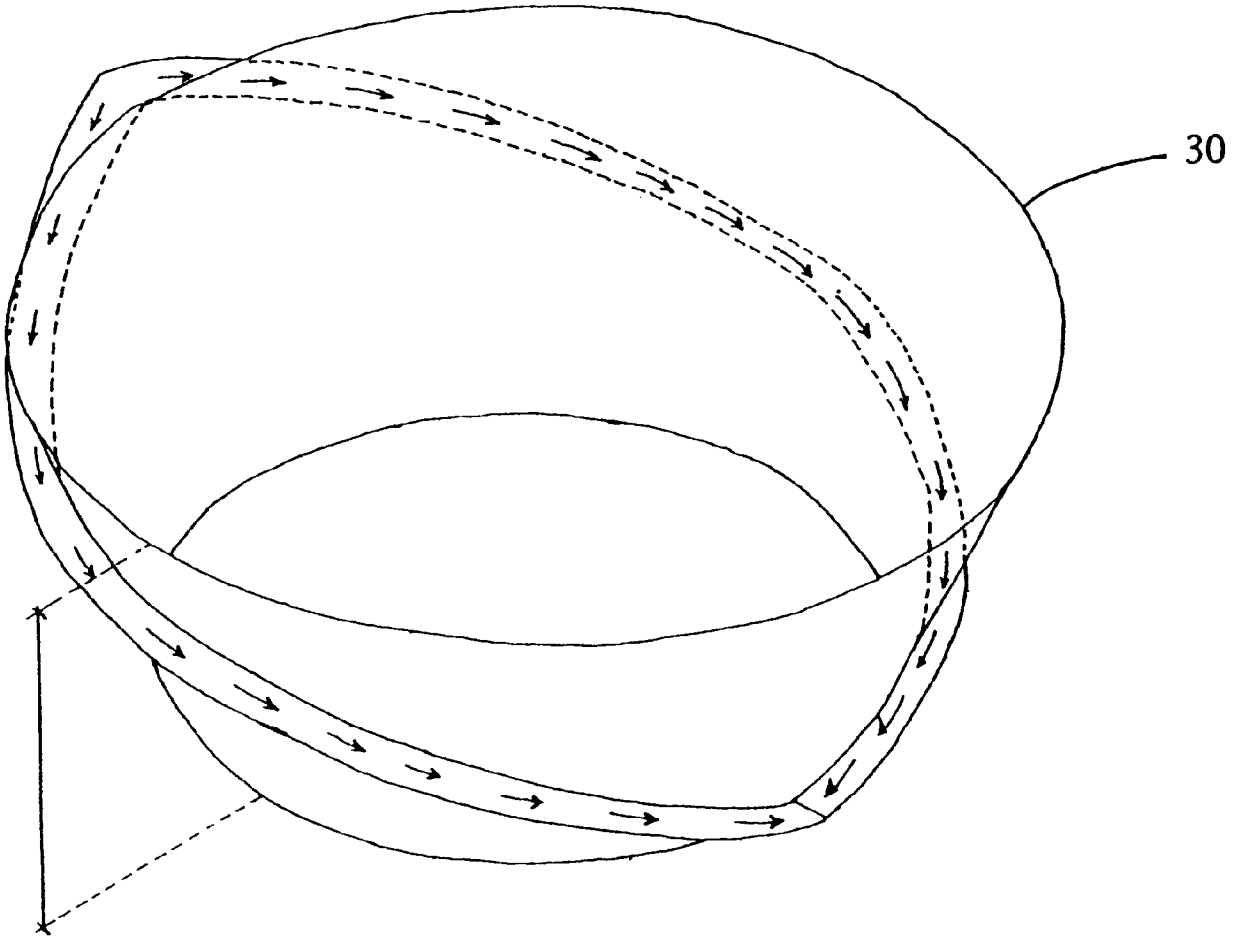
FIG. 7 is a schematic drawing showing the flow path of water and sand through the cone.
Figure 8:
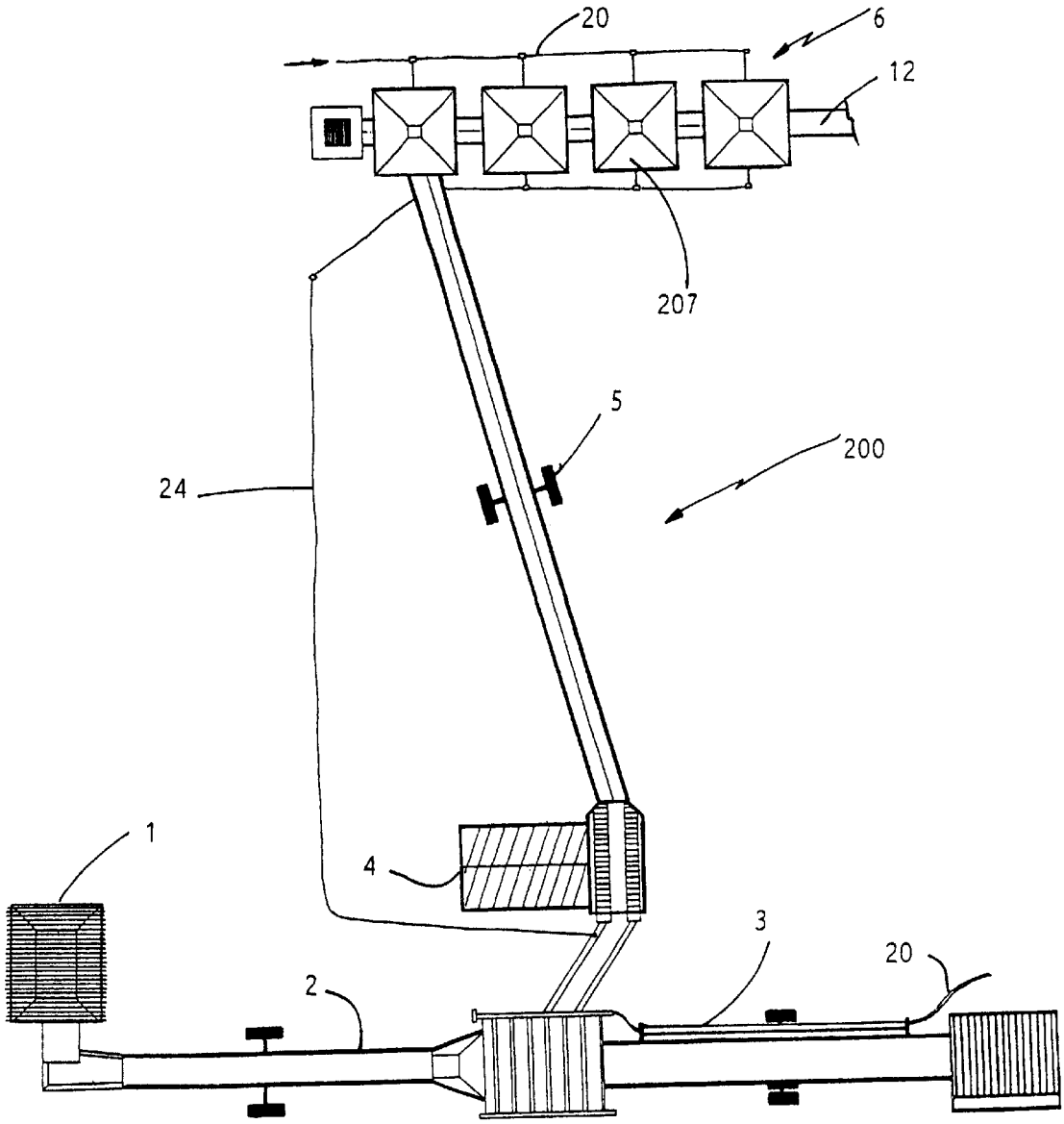
FIG. 8 is a plan view of the second embodiment of the plant according to the invention.
Figure 9:
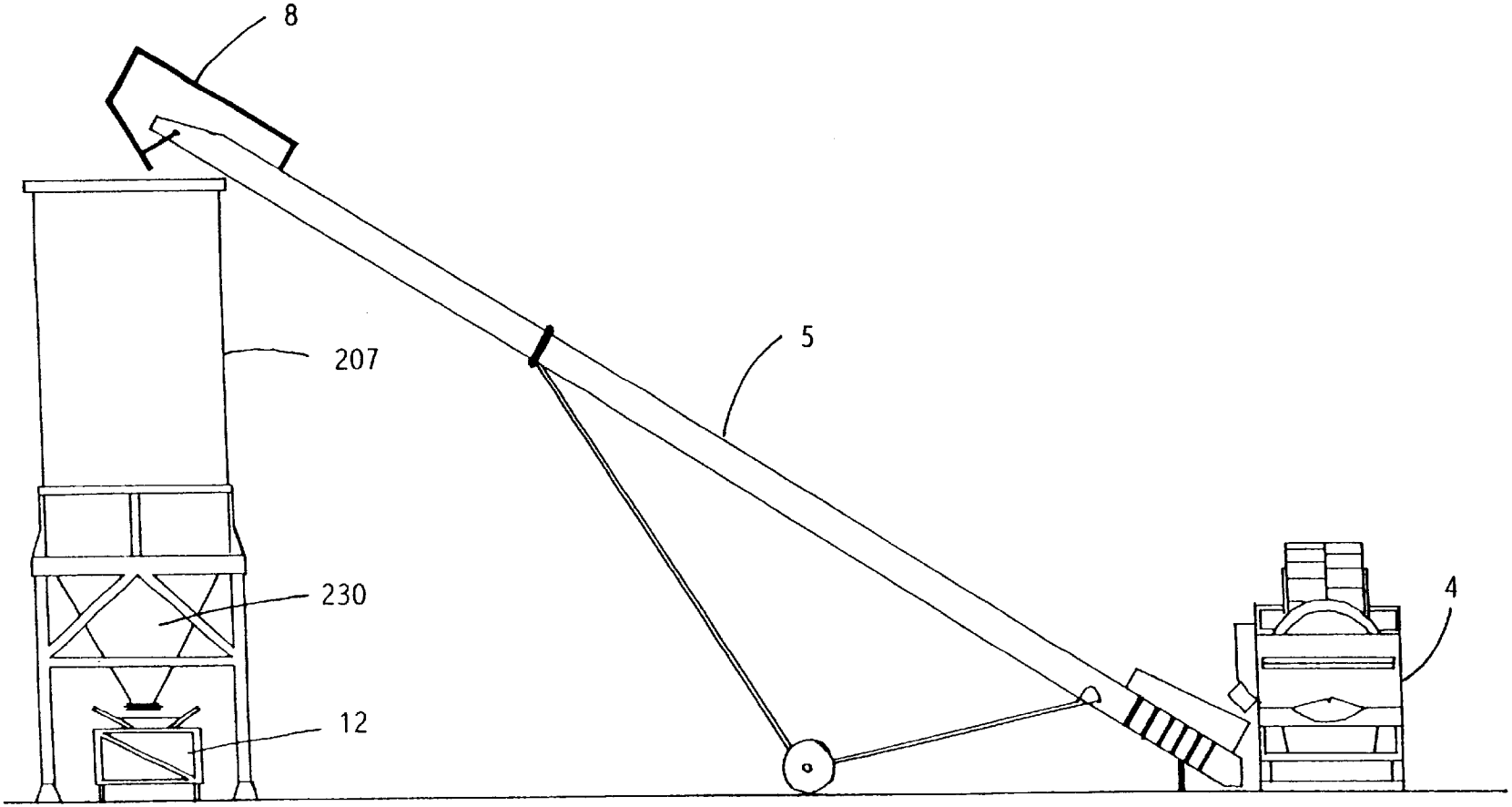
FIG. 9 is a side elevation of the plant shown in FIG. 8.
Figure 10:
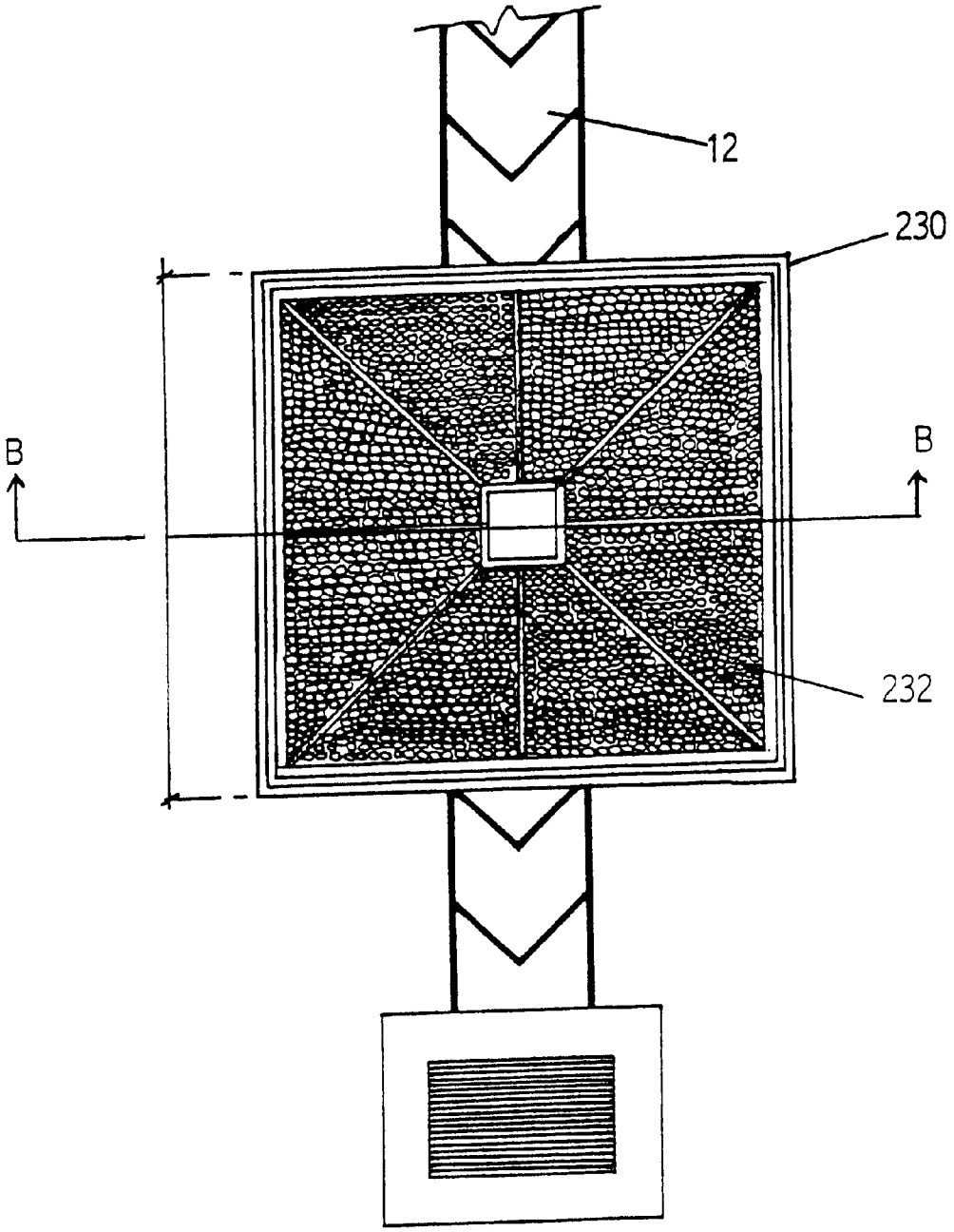
FIG. 10 is a plan view of a square cross-section tank included in the plant.
Figure 11:
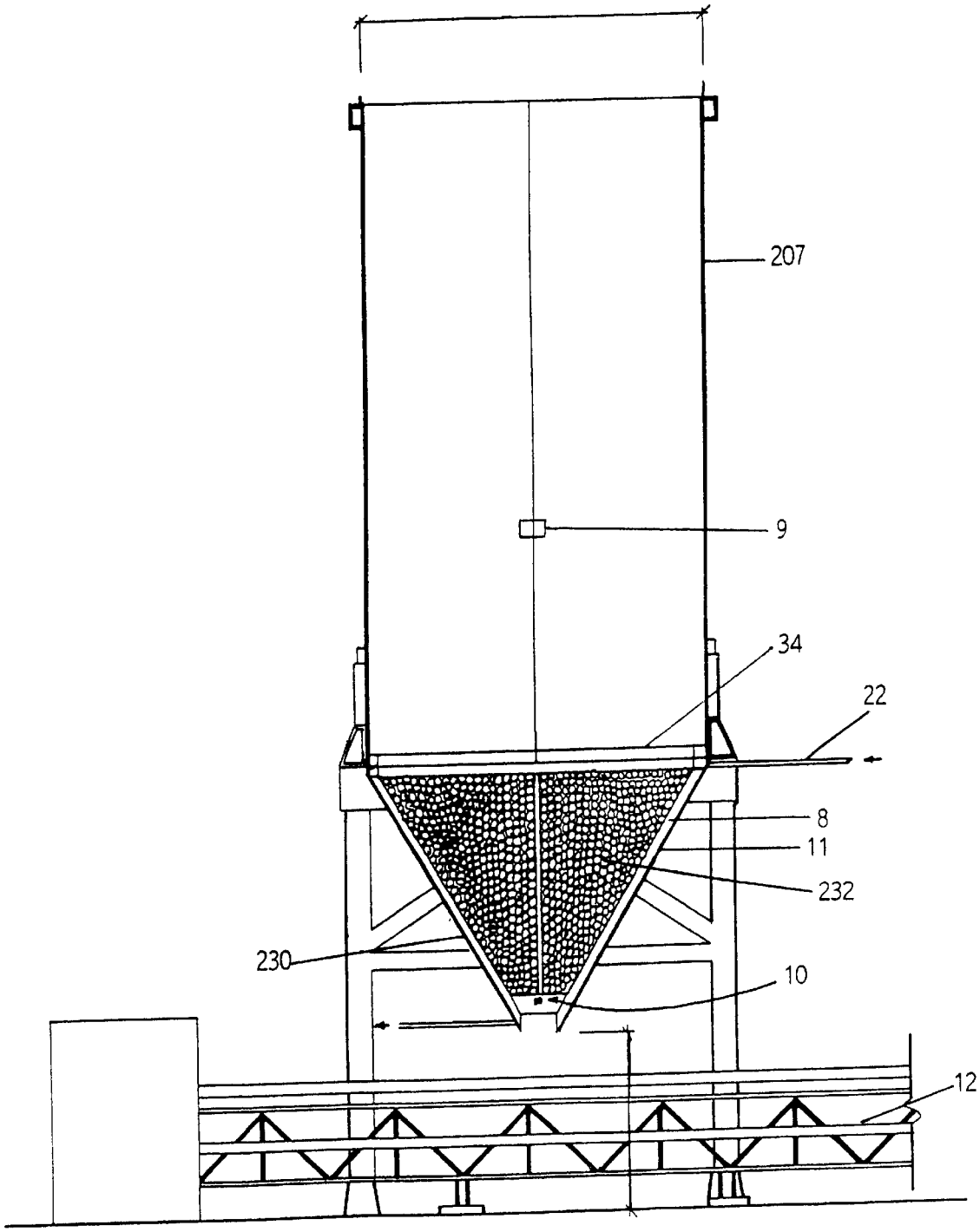
FIG. 11 is a sectional view along the line B—B of FIG. 10.
Figure 12:
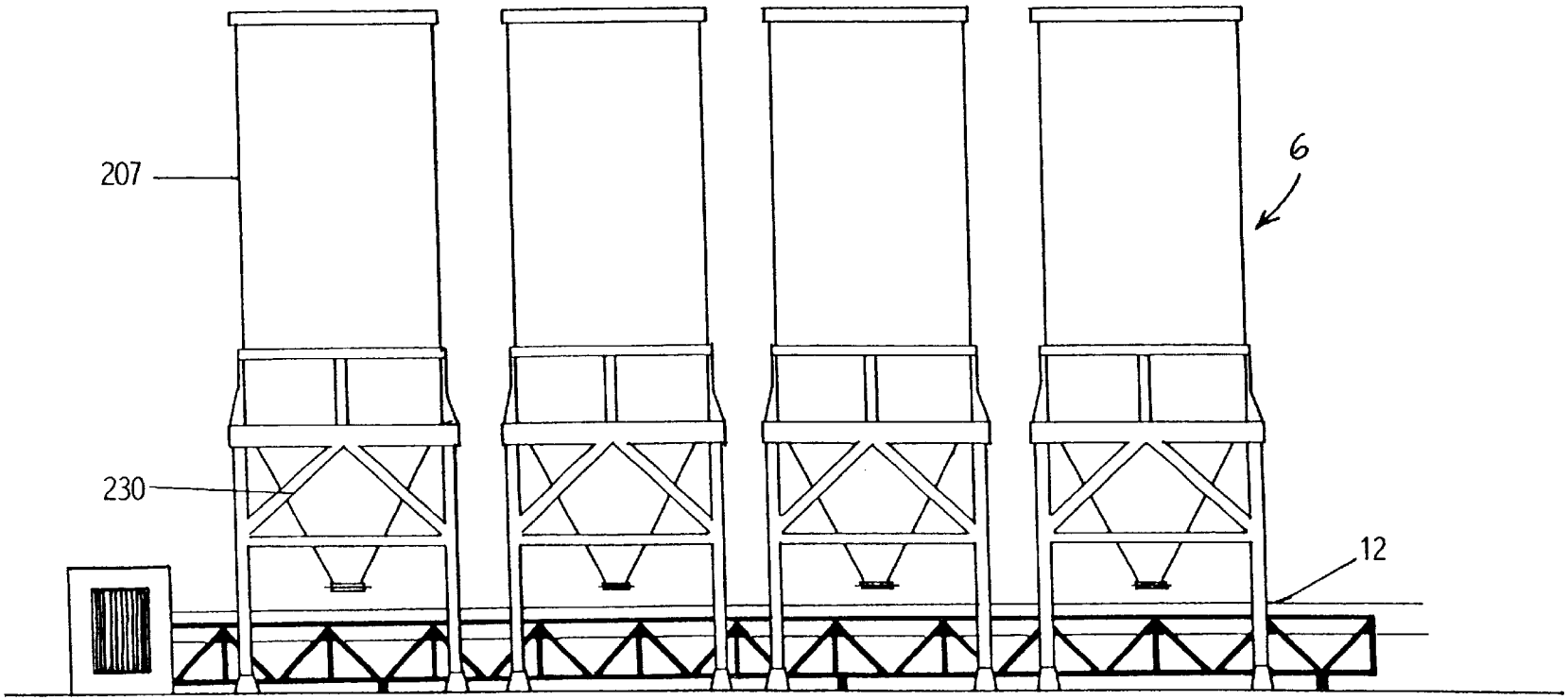
FIG. 12 is a front view of a plurality of tanks included in the second embodiment of plant of the invention.

The cone shaped filter 32 of each tank 7 includes an inner membrane 8 and the cone 30 includes an outer membrane 11. At the base of the tank 7, there is a distance of approximately 40 mm between the inner membrane 8 and the outer membrane 11. The inner membrane 8 is provided with apertures 15 which are approximately between 3 mm and 7 mm in diameter depending on the aggregate size. Filters with different sized apertures can be used depending on the grade of sand being dried. The apertures are spaced approximately 5 mm from each other. The inclusion of the apertures allows water to drain from the sand in the tank 7 through the inner membrane 8 into the space between the inner membrane 8 and the outer membrane 11 of the tank 7. The drainage water (mother liquor) runs down the outside wall of the inner membrane 8 and into an outlet pipe 24 from which the drainage water can be recycled back to the dewatering apparatus 4. The drainage water is recycled to the dewatering apparatus 4 via conduit 24 since quantities of small particles of sand are included in the drainage water and these would otherwise go to waste. There is a constant flow of water through the space between the inner membrane 8 and the outer membrane 11 to prevent the water from freezing during very cold weather and thereby blocking the tank 7. The water supplied for this purpose enters the space through conduit 22 and water jets (not shown) are spaced every 1.5 metres along the circumference of the main tank structure. The flow path for this water through the cone is shown in FIG. 7. The sand in each tank will dry to 8–10% w/w moisture content in one hour. The operation of the plant will now be described. Water enters the sand rinsing unit 3 via conduit 20 and is used to wash the sand. Washed sand emerging from the sand rinsing unit 3 is then moved by a conveyor belt to the dewatering apparatus 4 and from there the sand is transferred via the radial conveyor 5 into a first tank 7. When the first tank has been filled with washed sand up to a certain predetermined level, a motion detector 9 senses that the level has been reached and a signal is transferred from the motion detector 9 to the control unit of the radial conveyor belt 5 resulting in the conveyor being turned through a predetermined arc so that the conveyor will then be delivering washed sand to the second tank 7. Likewise, when the second tank 7 reaches a predetermined level as detected by the motion detector 9, the conveyor belt will again be moved through a predetermined arc so that sand is being delivered to the third tank 7 and so on. The moisture probe 10 in each tank is set to trigger the opening of a door (not shown) at the base of the tank thereby allowing the dried sand to flow out of the tank onto the stockpiling or loading conveyor when the moisture content has reached a predetermined level.

Thus, the washed sand drying and handling plant of the invention can be allowed to operate until after standard business hours, as it will switch itself off when all four tanks have been emptied of dried sand. Alternatively, instead of transporting the dried sand from the tanks to a stockpile, the sand can be transferred directly from any tank to a truck thereby reducing the amount of time spent loading trucks. There is a belt weight system on the dried sand loading conveyor 12 which can control the amount of sand to be delivered to a particular truck. Furthermore, if sand is required at start of business on a particular morning, one can switch off the automatic mode so that the tank door will not open and sand can be held in the tanks 7 overnight.

The second embodiment of plant 200 which is shown in FIGS. 8 to 12 is similar to the first embodiment 100 except that the tanks 207, cones 230 and filter 232 are square or rectangular in cross section and therefore are easier to construct. All the elements are given like numerals to the elements of the first embodiment of plant 100 and operate in a similar manner.

It will of course be understood that the invention is not limited to the specific details described herein, which are given by way of example only, and that various modifications and alterations are possible within the scope of the invention as defined in the appended claims.

What is claimed is:

1. A washed sand drying and handling plant (100,200) comprising apparatus (3) for washing sand with water;

apparatus (4) for dewatering the washed sand;

apparatus (5) for transporting the washed sand from the dewatering apparatus to one or more vessels (7,207) adapted for storing the dewatered sand and enabling the sand to dry by gravity, the sand being held in the or each vessel for a predetermined amount of time sufficient to allow the sand to dry to the desired level wherein each vessel includes an inner membrane (8) through which the liquid from the washed sand in the vessels (7,207) drains.

2. A washed sand drying and handling plant (100,200) as claimed in claim 1 including means (24) for collecting and recycling the drained liquid to the dewatering apparatus (4).

3. A washed sand drying and handling plant as claimed in claim 1 or 2 in which the plant includes a plurality of said vessels (7,207), whereby when a first vessel (7,207) is full, sand from the dewatering apparatus (4) is delivered to a second vessel (7,207) and so on.

4. A washed sand drying and handling plant as claimed in claim 3, including a conveyor (5) by means of which the sand is deliverable from the dewatering apparatus (4) to the vessel (7,207), the conveyor being moveable through an arc, so that the conveyor (5) can be moved through a predetermined angle.

5. A washed sand drying and handling plant as claimed in claim 4, in which the membrane (8) is provided on a removable filter element mountable within the outer wall of the cone.

6. A washed sand drying and handling plant as claimed in claim 3 in which the or each vessel is provided with a detector (9) to ascertain when it is full.

7. A washed sand drying and handling plant as claimed in claim 6, in which a door is provided at the base of each vessel and a conveyor (12) is located between the door or doors of the vessel or vessels, with the or each door being openable.

8. A washed sand drying and handling plant as claimed in claim 7 in which an adjustable chute is provided at the head of the transporting apparatus to direct sand into a vessel.

9. A washed sand drying and handling plant as claimed in claim 3 in which a moisture probe (10) is located at the base of the vessel for determining when the sand is at the required moisture level.

10. A washed sand drying and handling plant as claimed in claim 3 in which an adjustable chute is provided at the head of the transporting apparatus to direct sand into a vessel.

11. A washed sand drying and handling plant as claimed in claim 1, in which each vessel (7,207) comprises a tank having a cone shaped lower section (30,330), with the inner membrane (8) forming an inner wall of the cone and having a multiplicity of apertures to allow liquid to drain into a space between the inner wall and an outer wall of the cone.

12. A washed sand drying and handling plant as claimed in claim 4 or 11, in which a water supply is provided in the space between the inner and outer walls of the cone.

13. A sand drying vessel for use with a plant as claimed in claim 1 comprising a vessel (7,207) for holding wet sand, the vessel including an inner membrane (8) through which the liquid from the washed sand in the vessel (7,207) drains, the vessel further including a conical base (20,230), a complementary shaped filter (32,232) within the base spaced from the walls of the base to provide a drainage space between the filter and the base (30,230), whereby sand deposited in the vessel (7,207) dries by gravity and without the use of a heat source.

* * * * *